US005088071A

United States Patent [19]

Miyamoto et al.

[11] Patent Number: 5,088,071

[45] Date of Patent: Feb. 11, 1992

[54] TIME SWITCH

[75] Inventors: Kenichi Miyamoto; Yoshitaka Murakami; Toshimichi Suruga; Hideo Nanjoh, all of Okayama, Japan

[73] Assignee: Omron Tateisi Electronics Co., Kyoto, Japan

[21] Appl. No.: 271,672

[22] Filed: Nov. 16, 1988

[30] Foreign Application Priority Data

Nov. 16, 1987 [JP] Japan ..... 62-290396

[51] Int. Cl.[5] ..... G04B 47/00; G04C 19/00; H01H 43/00

[52] U.S. Cl. ..... 368/10; 368/82; 368/108; 307/141.4; 340/309.4

[58] Field of Search ..... 368/10, 107-113; 307/141, 141.4; 340/309.15, 309.4; 364/140, 143, 145, 569

[56] References Cited

U.S. PATENT DOCUMENTS

| | | | |
|---|---|---|---|
| 4,244,022 | 1/1981 | Kendall | 364/145 |
| 4,279,012 | 7/1981 | Beckedorff et al. | 340/309.4 |
| 4,325,081 | 4/1982 | Abe et al. | 364/144 |
| 4,392,043 | 7/1983 | Inoue | 219/69 P |
| 4,400,699 | 8/1983 | Glasmacher | 307/141 |
| 4,594,007 | 6/1986 | Brandenberg | 368/10 |
| 4,677,310 | 6/1987 | Midorikawa et al. | 364/145 |

FOREIGN PATENT DOCUMENTS

| | | |
|---|---|---|
| 0092211 | 4/1983 | European Pat. Off. . |
| 0141655 | 11/1984 | European Pat. Off. . |
| 0167848 | 6/1985 | European Pat. Off. . |

*Primary Examiner*—Vit W. Miska
*Attorney, Agent, or Firm*—Fish & Richardson

[57] ABSTRACT

A time switch turns on and off electric equipment connected to the switch. An on time at which the electric equipment is turned on and an off time at which the equipment is turned off are set through a time setting unit. Both the on time and the off time are displayed on a display unit.

12 Claims, 5 Drawing Sheets

TIME SWITCH

BACKGROUND AND FIELD OF THE INVENTION

This invention relates to a time switch, and more particularly to a time switch which displays not only a start time (on time) for actuating electrical equipment but also an actuation stop time (off time) for the equipment.

DISCUSSION OF THE RELATED ART

A time switch is disclosed in Japanese Kokoku Publication No. 61-7592. The switch displays an on time of a piece of electrical equipment on a display area, and automatically replaces the on time with the next on time on the display in response to detection of coincidence between the current time and the on time in the current time display.

The switch disclosed in this reference, however, displays only an on time and does not display an off time. Accordingly, it is very difficult or sometimes impossible for operators other than the operators who set the on/-off times to know when the equipment is going to be turned off.

SUMMARY OF THE INVENTION

It is, therefore, an object of this invention to provide a time switch which displays not only an on time but also an off time.

According to this invention, there is provided a time switch. The time switch includes (1) a first setting means for setting an on time at which electrical equipment connected to the switch is turned on, (2) a second setting means for setting an off time at which the electrical equipment is turned off, (3) a storage means for storing the on and off time, (4) a first displaying means for displaying the on time and (5) a second displaying means for displaying the off time.

BRIEF DESCRIPTION OF THE DRAWINGS

The above and other objects, advantages and features of this invention will be more fully understood in conjunction with the following figures, in which like numerals designate like or corresponding components and of which.

DETAILED DESCRIPTION OF THE INVENTION

Figure 1:
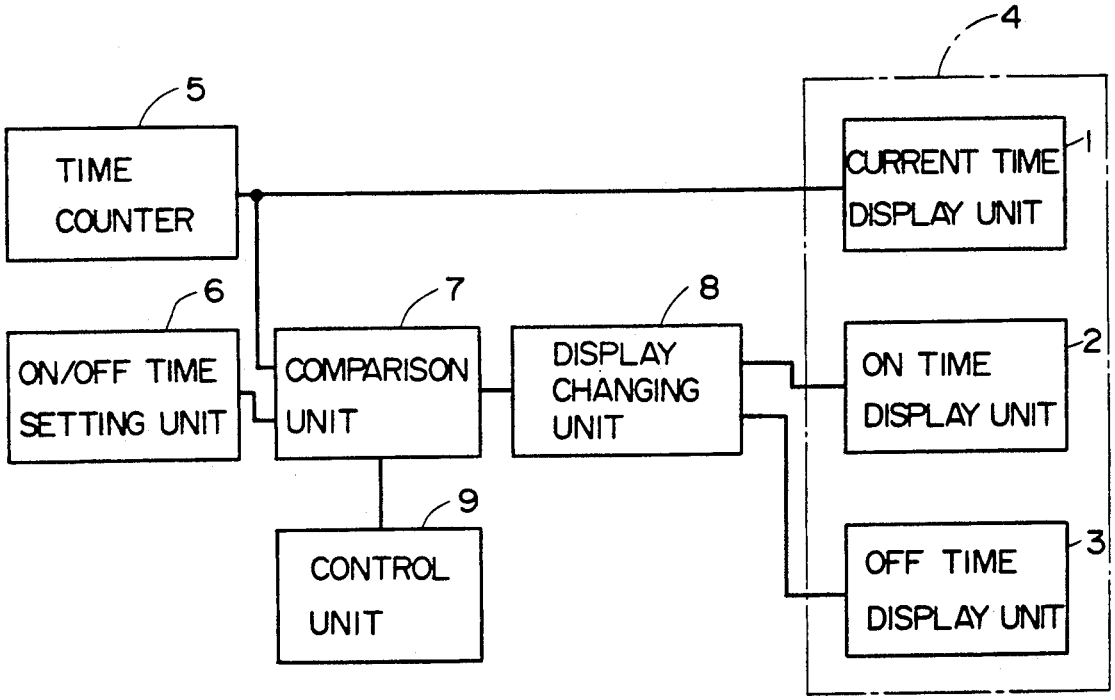
FIG. 1 is a schematic block diagram of this invention.

In FIG. 1, a display unit 4 includes a current time display unit 1 where the day of the week and the time by hours, minutes and seconds are displayed. Unit 4 further includes on time and off time display units 2 and 3. A time counter 5 and an on/off time setting unit 6 are tied to a comparison unit 7. Comparison unit 7 compares a current time fed from counter 5 with the time set through setting unit 6, and outputs electric signals in response to detection of coincidence between the current time and the set time. A control unit 9 outputs signals to operate electrical equipment, not shown, in response to signals transmitted from comparison unit 7. Display changing unit 8 replaces the time in on and off time displays 2 and 3 with the times necessary for the next on and off operation of the electric equipment. In more detail, display changing unit 8 replaces the on and off time in the displays 2 and 3 with the next on and off time in response to detection of coincidence between the current time and the off time in display 3.

Figure 2:
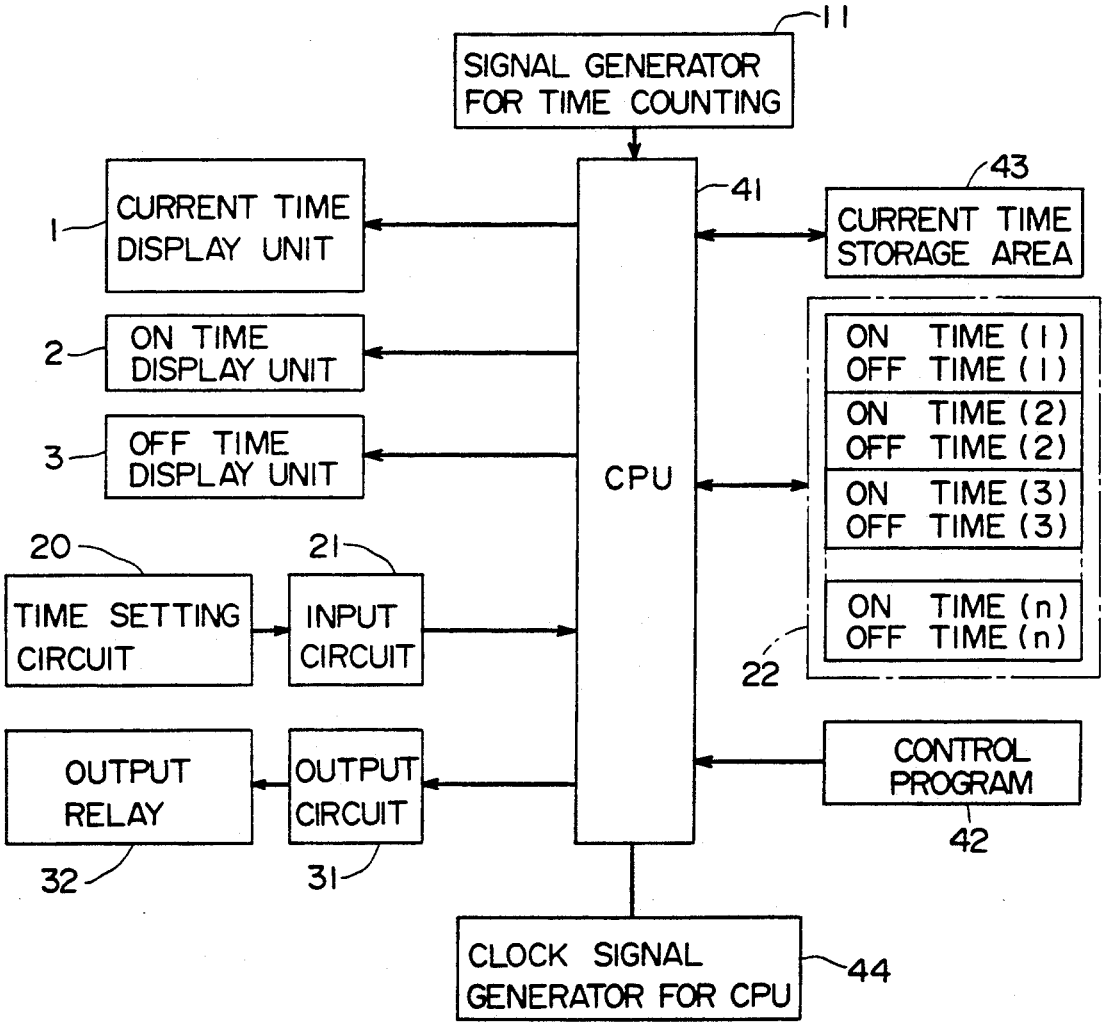
FIG. 2 is a circuit configuration of a first preferred embodiment of this invention.

FIG. 2 shows a time switch according to a first embodiment of this invention. The time switch includes a CPU 41. Signal generator 11 feeds reference signals for time counting to CPU 41. Following a control program 42, CPU 41 divides the frequency of the reference signals to count a current time, stores the current time into a current time storage area 43, and at the same time feeds it to current time display unit 1. On and off times set with setting circuit 20 are transmitted via input circuit 21 and CPU 41 to storage circuit 22, in which the on and off times are stored. The on and off times which are the closest to the current time are displayed on on time display unit 2 and off time display unit 3, respectively. CPU 41 compares the current time stored in storage area 43 with the off time closest to the current time. If the current time is found to be coincident with the off time, CPU 41 feeds an "off" signal to output circuit 31 to turn off output relay 32. A piece of electric equipment, not shown, is thus turned off. The next on and off times are displayed on display unit 2 and display unit 3, respectively, in response to the finding of coincidence.

Figure 3:
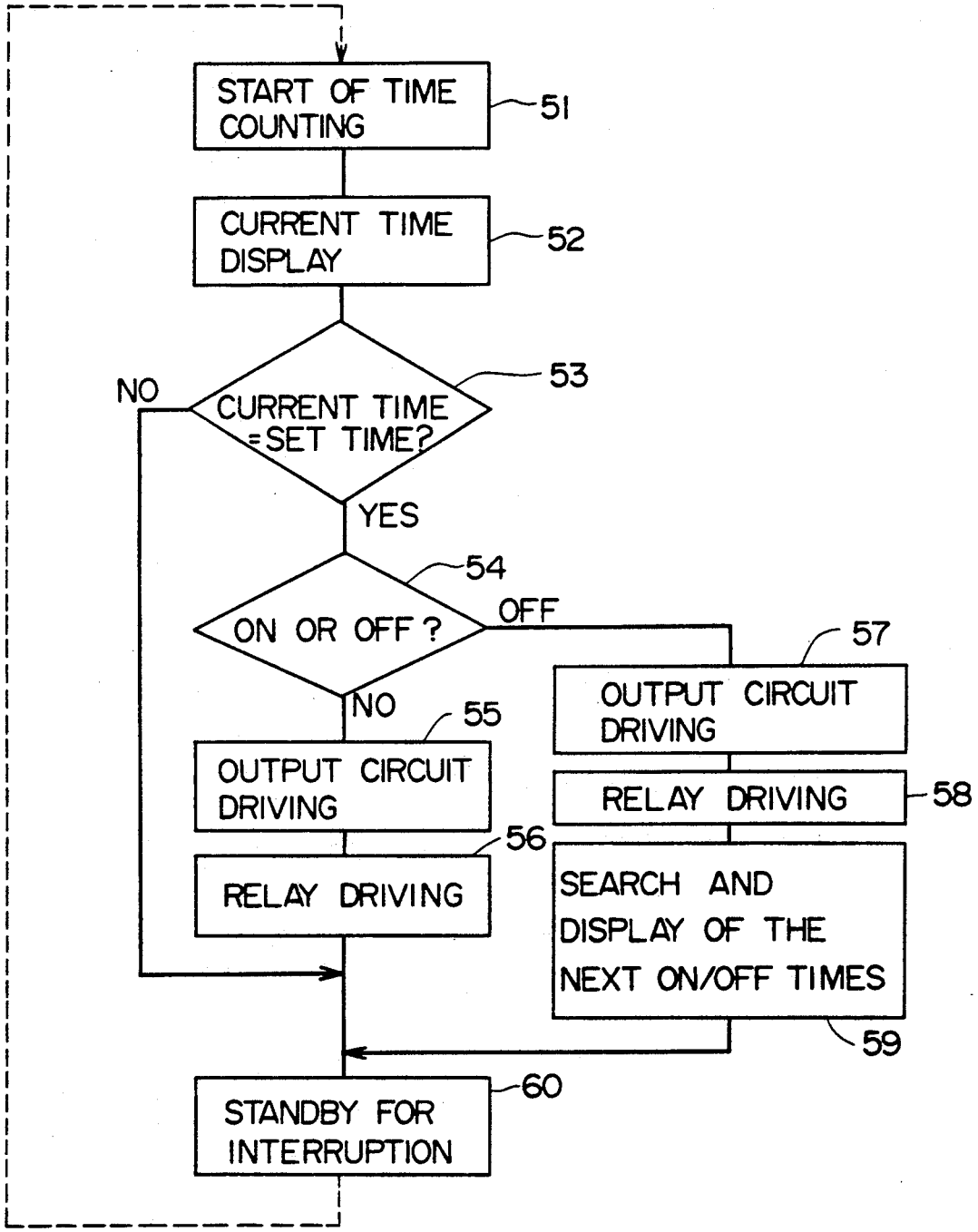
FIG. 3 is a flow chart of a control program for controlling the circuit of FIG. 2.
Figure 4A:
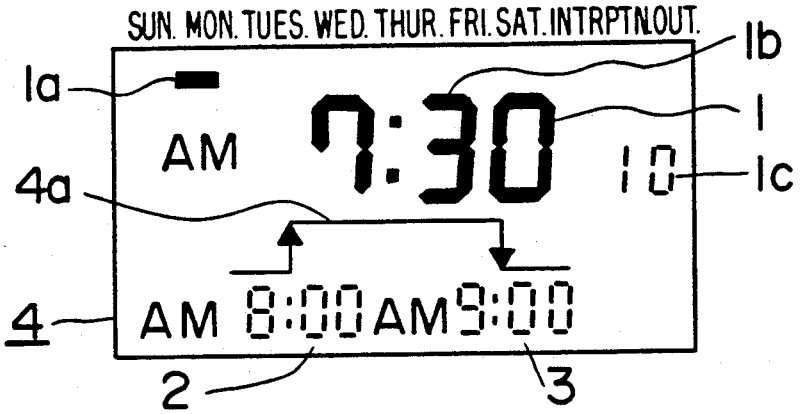
FIG. 4A is an example of displaying times on a display unit of this invention.
Figure 4B:
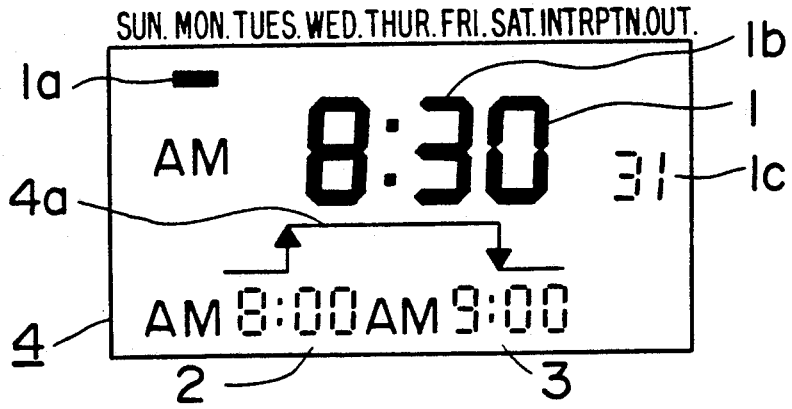
FIG. 4B is another example of displaying times on the display unit of this invention.
Figure 4C:
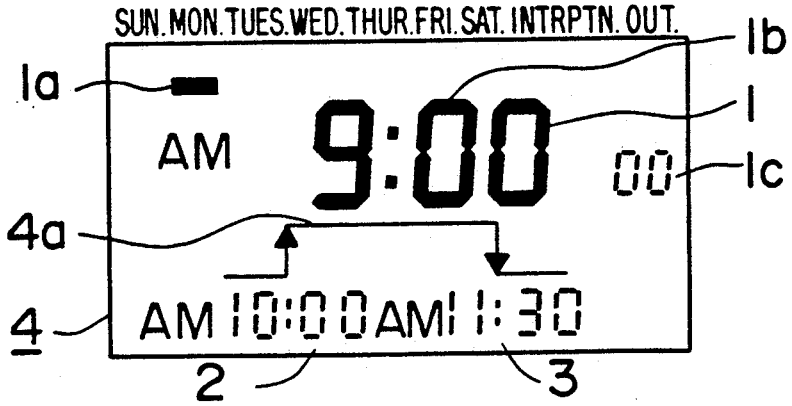
FIG. 4C is still another example of displaying times on the display unit of this invention.

FIG. 3 represents a flow chart of control program 42. If an interruption by one of reference signals is found in step 60, time counting is started from step 51. In more detail, CPU 41 divides the frequency of the reference signals outputted from signal generator 11 to count times. The current time is stored into current time storage area 43, while the time is displayed on current time display unit 1 in step 52. As shown in FIGS. 4A–4C, current time display unit 1 includes, for example, a day display area 1*a*, an hour and minute display area 1*b*, and a second display area 1*c*. In FIG. 4A, for example, a current time 7:30:31 a.m. is displayed on current time display unit 1. Moreover, as shown in FIG. 4A, the time 8:00 a.m. is set as an on time and displayed on display unit 2, while the time 9:00 a.m. is set as an off time and displayed on display unit 3. In addition to the time display, a simple time chart 4*a*, which uses a rising arrow for an on time and a falling arrow for an off time, is provided on the display unit 4.

In step 53, the current time stored in storage area 43 is compared with the set time closest to the current time. If the current time is found coincident with the set time, step 54 is executed. In step 54, it is checked to determine whether the current time is equal to the on time or to the off time in current display. If the current time is equal to the on time, CPU 41 outputs an "on" signal to output circuit 31 in step 55. In response to the "on" signal, output circuit 31 drives output relay 32 to turn on or actuate the electric equipment in step 56. As shown in FIG. 4B, the on time, in this embodiment, 8:00 is displayed even after the current time passes the on time. On the other hand, if the current time is found equal to the off time, in this embodiment, 9:00 a.m., in step 54, CPU 41 feeds an "off" signal to turn off output circuit 31 in step 57. In response to the "off" signal, output circuit 31 drives output relay 32 to turn off or deactivate the electric equipment in step 58. Thereafter, the next on and off times are displayed in step 59. In this embodiment, as shown in FIG. 4C, 10:00 is displayed as the next on time on display unit 2, while 11:30 is displayed as the next off time on display unit 3.

Figure 5:
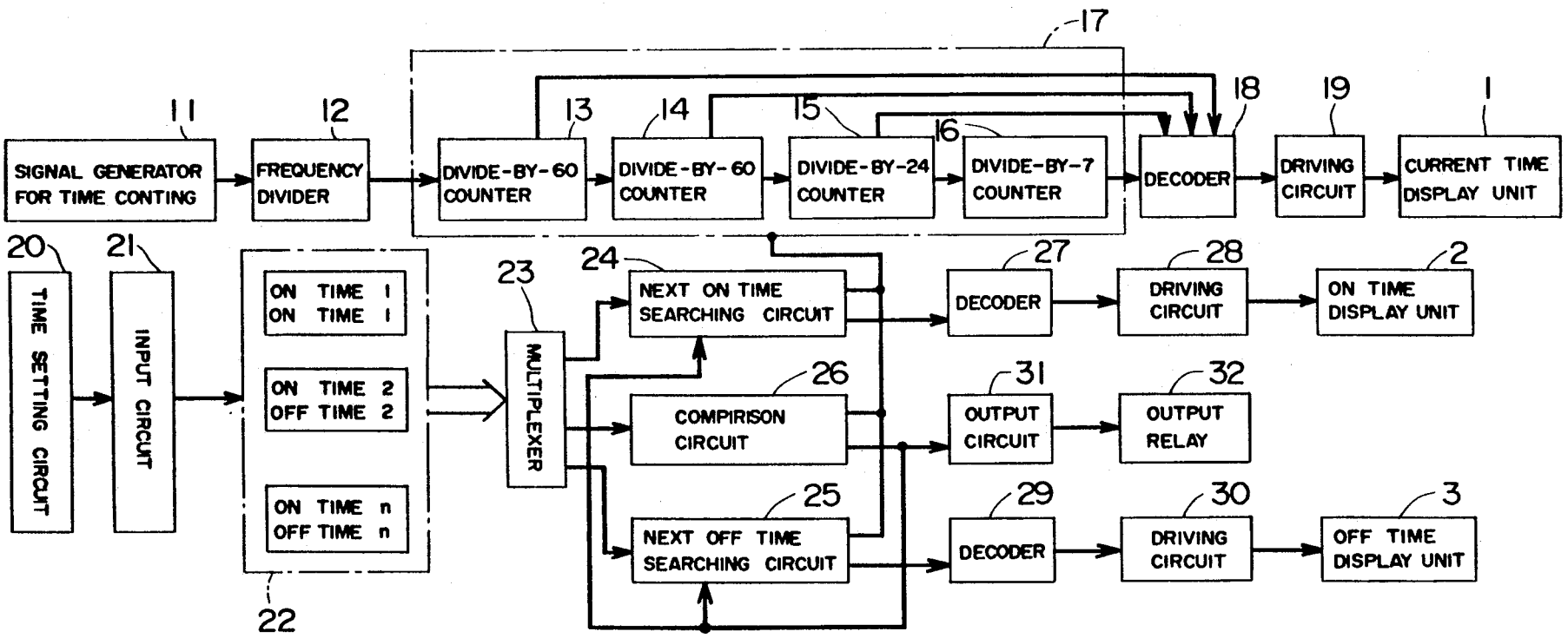
FIG. 5 is a circuit configuration of a second preferred embodiment of this invention.

FIG. 5 shows a circuit configuration which further illustrates the scheme given in FIG. 1. A signal generator 11 outputs reference signals for time counting, and a frequency divider 12 divides the frequency of signals supplied by generator 11. A divide-by-60 counter 13 counts in seconds signals outputted from frequency divider 12. A divide-by-60 counter 14 is joined to counter 13 to count in minutes output signals from counter 13. A divide-by-24 counter 15 is tied to counter 14 to count in hours output signals from counter 14. Moreover, a divide-by-7 counter 16 counts in days signals from counter 15. Time data obtained by counters 13–16 are fed to a decoder 18. Counters 13–16 provide a current time data circuit 17, and makes time counter 5 shown in FIG. 1 together with signal generator 1.

A driving circuit 19 drives time display unit 1 to display a current time thereon in response to output signals from decoder 18. A storage circuit 22 is connected to a time setting circuit 20 via an input interface 21. On/off time set through setting circuit 20 is stored into storage circuit 22. Time setting circuit 20 and storage circuit 22 comprise the time unit 6 shown in FIG. 1.

A multiplexer 23 allows the on and off times stored in storage circuit 22 to pass sequentially therethrough. An on time searching circuit 24, an off time searching circuit 25 and a comparison circuit 26 receive the time data transmitted through multiplexer 23. Multiplexer 23, on time searching circuit 24, off time searching circuit 25 and comparison circuit 26 form comparison unit 27 and display changing unit 8 as shown in FIG. 1. On time searching circuit 24 searches storage circuit 22 for the on time which is the closest to the current time and outputs the on time. A decoder 27 decodes on time data outputted from on time searching circuit 24 and sends the decoded signals to a dividing circuit 28. Driving circuit 28 drives on time display unit 2 in response to the decoded signals fed from decoder 27.

Off time searching circuit 25 searches storage circuit 22 for the off time which is the closest to the current time and outputs the off time. A decoder 29 decodes off time data outputted from off time searching circuit 25 and feeds the decoded signals to a driving circuit 30. Driving circuit 30 drives off time display unit 3 in response to the decoded signals fed from decoder 29.

An output circuit 31 is tied to comparison circuit 26, and an output relay 32 is connected to output circuit 31. Output circuit 31 and relay 32 form control unit 9 as shown in FIG. 1. Comparison circuit 26 compares the current time with the set times (on and off time) which have been stored in storage circuit 22 and which are the closest to the current time. Upon finding out that the current time has become equal to the on time, comparison circuit 26 outputs an "on" signal to output circuit 31. In response to the "on" signal, output circuit 31 drives relay 32 to turn on a piece of electric equipment, not shown, which is connected to relay 32. On the other hand, if the current time has become equal to the off time, comparison circuit 26 outputs an "off" signal to output circuit 31. Output circuit 31 drives, in response to the "off" signal, relay 32 to turn off the electric equipment. In the foregoing embodiments, display unit 4 is made of liquid crystal.

As mentioned above, since not only an on time but also an off time is displayed, it can be easily known when an electric equipment is turned on and off. In addition, the display of both on time and off time allows easy understanding as to how long a particular piece of electric equipment has operated. Moreover, the time chart allows quick understanding as to which time is displayed as an on time or off time.

The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

We claim:

1. A time switch, comprising:
a first setting means for setting an on time at which electric equipment connected to said switch is turned on;
a second setting means for setting an off time at which said electric equipment is turned off;
a storage means for storing said on and off time;
a first displaying means for displaying said on time;
a second displaying means for displaying said off time;
and an updating means for automatically updating said on and off times upon coincidence of a current time with said off time.

2. The time switch as in claim 1, wherein said first and second setting means comprise a single setting means.

3. The time switch as in claim 1, wherein said first and second displaying means are a liquid crystal display.

4. The time switch as in claim 1, further comprising a plurality of further first and second setting means for setting further on and off times at which the equipment is turned on and off, respectively.

5. A time switch, comprising:
a first setting means for setting an on time at which electric equipment connected to said switch is turned on;
a second setting means for setting an off time at which said electric equipment is turned off;
a storage means for storing said on and off times;
a counting means for counting a current time and for outputting the current time;
a first displaying means for displaying the current time transmitted from said counting means;
an on time searching means for searching said storage means for the on time which is the closest to the current time counted by said counting means and for outputting the closest on time; an off time searching means for searching said storage means for the off time which is the closest to the current time counted by said counting means and for outputting the off time;
a second displaying means for displaying said closest on time;
a third displaying means for displaying said closest off time;
a first comparing means for comparing the current time counted by said counting means with said closest on time and for outputting a signal in response to detection of coincidence between the current time and said closest on time;

a second comparing means for comparing the current time counted by said counting means with said closest off time and for outputting a signal in response to detection of coincidence between the current time and said closest off time; and a controlling means for controlling said electric equipment in response to said signal transmitted from one of said first and second comparing means.

6. The time switch as in claim 5, further comprising a plurality of further first and second setting means for setting further on and off times at which the equipment is turned on and off, respectively.

7. The time switch as in claim 5 or 6, wherein said counting means includes a signal generator for feeding reference signals for current time counting, a first counter for counting in seconds signals outputted from said signal generator, a second counter for counting in minutes signals outputted from said first counter, a third counter for counting in hours signals outputted from said second counter, and a fourth counter for counting in days signals outputted from said third counter.

8. The time switch as in claim 5, wherein said first and second setting means are provided by a single setting means.

9. The time switch as in claim 5, wherein said first and second comparing means are provided by a single comparing means.

10. The time switch as in claim 5 or 6, wherein said counting means, said on time searching means, said off time searching means, said first comparing means and said second comparing means are provided by a central processing unit.

11. The time switch as in claim 5 or 6, wherein said controlling means includes an output circuit for outputting a signal in response to a signal transmitted from one of said first and second comparing means, and relay for controlling said electric equipment in response to said signal transmitted from said output circuit.

12. The time switch as in claim 5 or 6, wherein said first, second and third displaying means are provided by a liquid crystal display.

* * * * *